US005178944A

United States Patent [19]

Horiuchi et al.

[11] Patent Number: 5,178,944

[45] Date of Patent: Jan. 12, 1993

[54] RECORDING MATERIAL

[75] Inventors: Hiroshi Horiuchi, Toyonaka; Hirofumi Tsuka, Higashiosaka; Nobuyuki Matsuda, Sakai, all of Japan

[73] Assignee: Sumitomo Chemical Co., Ltd., Japan

[21] Appl. No.: 183,092

[22] Filed: Apr. 19, 1988

[30] Foreign Application Priority Data

Apr. 20, 1987 [JP] Japan ..... 62-97016
Jun. 26, 1987 [JP] Japan ..... 62-160250

[51] Int. Cl.[5] ..... B41M 5/00

[52] U.S. Cl. ..... 428/341; 346/135.1; 428/198; 428/211; 428/342; 428/411.1; 428/500

[58] Field of Search ..... 428/195, 211, 341, 342, 428/537.5, 340, 411.1, 500; 346/135.1

[56] References Cited

U.S. PATENT DOCUMENTS 4,248,939 2/1981 Parsons ..... 428/508
4,540,728 9/1985 Nakahara et al. ..... 524/100
4,613,525 9/1986 Miyamoto et al. ..... 428/195
4,788,267 11/1988 Chiao et al. ..... 526/287

FOREIGN PATENT DOCUMENTS 1286457 7/1991 Canada ..... 428/195
61-252398 10/1986 Japan .

*Primary Examiner*—Pamela R. Schwartz
*Attorney, Agent, or Firm*—Birch, Stewart, Kolasch & Birch

[57] ABSTRACT

A recording material comprising a base material and at least one polymer selected from the group consisting of a homopolymer of diallylamine, copolymers of diallyamine with (meth)acrylamide and optionally at least one other vinyl monomer having substantially no carboxyl group, and salts thereof which is contained in said base material or in a coating layer formed on said base material, on which an ink is printed with good initial coloring property and a printed image with higher resolution and improved water and light resistance.

19 Claims, No Drawings

RECORDING MATERIAL

BACKGROUND OF THE INVENTION

1. Field of the Invention

The present invention relates to a recording material such as a recording paper. More particularly, it relates to a recording material on which the coloring property of an ink comprising a water soluble dye is excellent and a printed image has high resolution and water and light resistance.

2. Description of the Related Art

In an ink jet printing method, droplets of ink are formed by various mechanisms and injected from nozzles onto a surface of a recording material such as a paper sheet to print an image thereon. Since the ink jet printing is very quiet and generates images very quickly and can record images with various colors, it is increasingly used in a printing field.

As the recording material for ink jet printing, conventional paper has been used generally. However, with improvement of the ink jet printing machine such as an increase in recording speed and/or multicoloring and with the enlargement of application fields, the recording material is now required to have improved properties. That is, for recording a colored image having substantially the same resolution and quality as a color photograph, the recording material should satisfy the following requirements:

1. The recording material absorbs the ink quickly.
2. When two or more dots overlap with each other, the subsequently injected ink does not migrate over the already printed dot(s).
3. The ink forms a substantially round dot and the dot periphery is smooth.
4. The diameter of an ink dot is not unnecessarily enlarged.
5. The ink concentration in the dot is high and the dot periphery is not blurred.
6. The ink exhibits a good coloring property on the recording material. In addition, the ink is required to exhibit good resistence to water and light.

However, no recording material that satisfies all of the above requirements has been developed.

To increase ink absorption of the recording material, various attempts have been made, for example, impregnation of a water-soluble polymer in a paper sheet to which urea-formaldehyde resin powder is internally added (Japanese Patent Kokai Publication No. 49113/1978), formation of an ink absorbing coating layer on a paper sheet (Japanese Patent Kokai Publication No. 5830/1980) and use of non-glued silica powder as a pigment in the coating layer (Japanese Patent Kokai Publication No. 51583/1980). Although ink absorption is somewhat increased by these methods, the printed image lacks water resistance.

To solve this problem, it has been proposed to render the printed ink water resistant by adding to the recording material a cationic polymer such as polyethyleneimine, polyvinylpyridinium halide (Japanese Patent Kokai Publication No. 84992/1981) and dimethyldiallylammonium chloride (Japanese Patent Kokai Publication No. 20696/1984). However, the improvement of water resistance of the printed ink is still unsatisfactory and the light resistance of the ink decreases.

SUMMARY OF THE INVENTION

An object of the present invention is to provide a recording material, particularly recording paper on which the coloring property of an ink is excellent and the recorded image thereon has high resolution and high resistance to water and light.

Accordingly, the present invention provides a recording material comprising a base material and at least one polymer selected from the group consisting of a homopolymer of diallylamine, copolymers of diallyamine with (meth)acrylamide and optionally at least one other vinyl monomer having substantially no carboxyl group, and salts thereof (hereinafter referred to as "polymer of the present invention") which is contained in said base material or in a coating layer formed on said base material.

DETAILED DESCRIPTION OF THE INVENTION

In the polymer of the present invention, the molar fraction of diallyamine is at least 0.1, preferably from 0.15 to 0.95, and the molar fraction of (meth)acrylamide is from 0 to 0.9, preferably from 0.05 to 0.85. Further, a molar fraction of the optionally contained other vinyl monomer is from 0 to 0.3. When the molar fraction of diallylamine is less than 0.1, water resistance of the printed image is not sufficient.

Specific examples of other vinyl monomers having substantially no carboxyl group are (meth)acrylonitrile, vinyl acetate, lower alkyl (meth)acrylate, hydroxyalkyl (meth)acrylate, styrenes and the like.

The polymer of the present invention includes its salts, which may be a salt with an inorganic or organic acid, e.g. hydrochloric acid, sulfuric acid, acetic acid, oxalic acid, etc.

The polymer of the present invention may be prepared by homo- or co-polymerizing diallyamine or other monomer(s) in an aqueous medium in the presence of a polymerization initiator. As the polymerization initiator, any of those used in polymerization in an aqueous medium can be used. Examples of the initiator are hydrogen peroxide, potassium persulfate, ammonium persulfate and the like. The polymerization temperature is usually from 20 to 100° C., preferably from 40 to 90° C., and the polymerization time is usually from 2 to 30 hours.

The polymerization is preferably effected in an inert gas atmosphere such as nitrogen gas, although it may be effected in the presence of oxygen.

A typical base material is a paper sheet, although other materials such as fabric, resin films and synthetic paper may be used.

The recording material of the present invention may be prepared by a per se conventional method with the modification being the use of the polymer of the present invention in a suitable step of the method. For example, the recording material of the present invention may be prepared by sheet forming by using an aqueous solution of the polymer of the present invention or dipping the base material in an impregnation liquid containing the polymer of the present invention.

The content of the polymer of the present invention is preferably from 0.05 to 10 g, more preferably from 0.1 to 5 g per square meter of the base material. When the content of the polymer of the present invention is less than the above lower limit, the effects of the present invention such as water resistance of the printed image are not effectively achieved. If it is larger than the above upper limit, the effects of the present invention are not materially increased and too much polymer of the present invention is uneconomically contained in the recording material.

When the polymer of the present invention is contained in the coating layer, it is added in a coating liquid, which is applied on the base material and dried by a conventional method. Examples of other additives contained in the coating liquid are inorganic pigments (e.g. finely ground silicic acid, clay, talc, diatomaceous earth, calcium carbonate, barium sulfate, titanium oxide, zinc oxide, satin white, aluminum silicate, etc.), water-soluble polymers (e.g. starch, gelatin, casein, gum arabic, sodium alginate, carboxylmethylcellulose, polyvinyl alcohol, polyvinylpyrrolidone, polyacrylate soda, polyacrylamide, etc.), synthetic rubber latexes, synthetic resin emulsions (e.g. ethylene-vinyl acetate polymer emulsion, etc.), a dispersant, a fluorescent dye, a pH adjusting agent, a foam inhibitor, a lubricant, a preservative, a surfactant and the like.

The amount of the polymer of the present invention to be coated is from 0.05 to 10 g, preferably from 0.1 to 5 g per square meter of the base material. When the amount of the polymer of the present invention is less than the lower limit, the effects of the present invention such as water resistance of the printed image are not effectively achieved. If it is larger than the above upper limit, the effects of the present invention are not materially increased and too much polymer of the present invention is uneconomically contained in the recording material.

The coating liquid containing the polymer of the present invention is coated on the base material by a per se conventional method, for example, by a roll coater method, a blade coater method or an air knife method in an amount of 1 to 40 g/m$^2$, preferably 2 to 30 g/m$^2$ (dry base).

When the polymer of the present invention is contained in the base material or in the coating layer on the base material, the ink applied thereon is smoothly absorbed therein and quickly fixed therein. Thereby, a clear image is produced. The produced image has good water and light resistance. Therefore, the recording material of the present invention is particularly suitable for ink jet printing.

PREFERRED EMBODIMENTS OF THE INVENTION

Practically and presently preferred embodiments of the present invention are shown in the following Examples, in which "%" and "parts" are by weight unless otherwise indicated.

PREPARATION EXAMPLE 1

In a reactor, diallyamine (27.2 g, 0.28 mole), water (19.7 g), 36 % hydrochloric acid (28.4 g, 0.28 mole) were charged and heated to 70° C. in a nitrogen atmosphere. As a polymerization initiator, ammonium persulfate (0.3 g) was added and polymerization was proceeded for 10 hours at the same temperature. During polymerization, ammonium persulfate (0.3 g) and water (112 g) were added. After completion of the polymerization, water (62 g) was added to obtain an aqueous solution of a polymer having a concentration of 15 %, pH of 4 and viscosity of 3.8 poise (25° C.). This polymer solution is designated as Polymer A.

PREPARATION EXAMPLE 2

In a reactor, diallyamine (36.9 g, 0.38 mole), a 50 % aqueous solution of acrylamide (2.84 g, 0.02 mole), water (26.5 g), 36 % hydrochloric acid (37.4 g, 0.38 mole) were charged and heated to 70° C. in a nitrogen atmosphere. As a polymerization initiator, ammonium persulfate (0.6 g) was added and polymerization was proceeded for 10 hours at the same temperature. During polymerization, ammonium persulfate (0.5 g) was added. After completion of the polymerization, water (240.5 g) was added to obtain an aqueous solution of a polymer having a concentration of 15 %, pH of 1.2 and viscosity of 1.0 poise (25° C.). This polymer solution is designated as Polymer B.

PREPARATION EXAMPLE 3

In a reactor, diallyamine (35 g, 0.36 mole), a 50 aqueous solution of acrylamide (34.1 g, 0.24 mole), water (328 g), 36 % hydrochloric acid (36.5 g, 0.36 mole) were charged and heated to 70° C. in a nitrogen atmosphere. As a polymerization initiator, ammonium persulfate (0.4 g) was added and polymerization was proceeded for 10 hours at the same temperature to obtain an aqueous solution of a polymer having a concentration of 15 %, pH of 3 and viscosity of 4.4 poise (25° C.). This polymer solution is designated as Polymer C.

PREPARATION EXAMPLE 4

In a reactor, diallyamine (11.6 g, 0.12 mole), a 50 % aqueous solution of acrylamide (39.2 g, 0.28 mole), water (173 g), 36 % hydrochloric acid (12.2 g, 0.12 mole) were charged and heated to 70° C. in a nitrogen atmosphere. As a polymerization initiator, ammonium persulfate (0.5 g) was added and polymerization was proceeded for 10 hours at the same temperature to obtain an aqueous solution of a polymer having a concentration of 15 %, pH of 3 and viscosity of 44 poise (25° C.). This polymer solution is designated as Polymer D.

COMPARATIVE PREPARATION EXAMPLE

In a reactor, diallydimethylammonium chloride (78.3 g, 0.5 mole) and water (443 g) were charged and heated to 70° C. in a nitrogen atmosphere. As a polymerization initiator, ammonium persulfate (0.7 g) was added and polymerization was proceeded for 10 hours at the same temperature to obtain an aqueous solution of a polymer having a concentration of 15 %, pH of 3.0 and viscosity of 2.6 poise (25° C.). This polymer solution is designated as Polymer E.

EXAMPLE 1

From the following components, a coating composition comprising Polymer A was prepared:

| Component | Parts |
|---|---|
| Finely ground silicic acid | 100 |
| Polyvinyl alcohol | 50 |
| Polymer A | 30 |
| Water | 600 |

On a sheet of general wood free paper having 10 seconds of Stöckigt sizing degree (basis weight: 55 g/m$^2$) as a base material, the prepared coating composition was coated in an amount of 10 g/m$^2$ as dried materials, which corresponded to a coated amount of 0.29 g/m$^2$ of Polymer A by a wire rod and dried at 120° C.

for 2 minutes followed by pressing at 110° C. for one minute to obtain a recording material. On this recording material an image was ink jet printed by means of a color image printer IO-0700 (manufactured by Sharp Corporation) and recording properties were evaluated as follows:

Initial coloring property

Measured by a Macbeth color densitometer (RD-915)

Water resistance

The printed paper sheet is immersed in a water stream at 25° C. for 15 minutes and then the color concentration is measured by the Macbeth color densitometer.

Light resistance

The printed paper sheet is set in a fade meter and irradiated at 60° C. for 40 hours and then a color concentration is measured by the Macbeth color densitometer.

The results are shown in Table 1.

EXAMPLES 2, 3 and 4

In the same manner as in Example 1 but using Polymer B, C or D in place of Polymer A, a recording material was prepared and its recording properties were evaluated. The results are shown in Table 1.

EXAMPLE 5 and 6

From the following components, a coating composition comprising Polymer A or B was prepared:

| Component | Parts |
|---|---|
| Finely ground silicic acid | 100 |
| Polyvinyl alcohol | 40 |
| Polymer A or B | 233 |
| Water | 502 |

On a sheet of general wood free paper having 10 seconds of Stöckigt sizing degree (basis weight: 55 g/m$^2$) as a base material, the prepared coating composition was coated in an amount of 10 g/m$^2$ as dried materials, which corresponded to a coated amount of 2.0 g/m$^2$ of Polymer A or B by a wire rod and dried at 120° C. for 2 minutes followed by pressing at 110° C. for one minute to obtain a recording material. The properties of the produced recording material were evaluated in the same manners as in Example 1. The results are shown in Table 1.

COMPARATIVE EXAMPLE 1

In the same manner as in Example 1 but using no polymer of the present invention, a recording material was prepared and its properties were evaluated. The results are shown in Table 1.

COMPARATIVE EXAMPLE 2

In the same manner as in Example 1 but using polyethyleneimine in place of Polymer A, a recording material was prepared and its properties were evaluated. The results are shown in Table 1.

COMPARATIVE EXAMPLE 3

In the same manner as in Example 1 but using Polymer E in place of Polymer A, a recording material was prepared and its properties were evaluated. The results are shown in Table 1.

EXAMPLES 7–10

In an aqueous solution of each of Polymers A, B, C and D containing 1% of the polymer as such, a sheet of general wood free paper having 0 seconds of Stöckigt sizing degree (basis weight: 60 g/m$^2$) was dipped and dried to obtain a recording material containing the polymer of the present invention in an amount of about 0.5 g/m$^2$. Its properties were evaluated in the same manners as in Example 1. The results are shown in Table 2.

EXAMPLES 11 and 12

In an aqueous solution of Polymer A or B containing 4% of the polymer as such, a sheet of general wood free paper having 0 seconds of Stöckigt sizing degree (basis 1 weight: 60 g/m$^2$) was dipped and dried to obtain a recording material containing the polymer of the present invention in an amount of about 2 g/m$^2$. Its properties were evaluated in the same manners as in Example 1. The results are shown in Table 2.

COMPARATIVE EXAMPLE 4

In the same manner as in Example 7 but using polyethyleneimine in place of Polymer A, a recording material was prepared. Its properties were evaluated in the same manners as in Example 1. The results are shown in Table 2.

COMPARATIVE EXAMPLE 5

In the same manner as in Example 8 but using Polymer E in place of Polymer B, a recording material was prepared. Its properties were evaluated in the same manner as in Example 1. The results are shown in Table 2.

TABLE 1

| Example No. | 1 | 2 | 3 | 4 | 5 | 6 | C.1 | C.2 | C.3 |
|---|---|---|---|---|---|---|---|---|---|
| Polymer*1) | A | B | C | D | A | B | — | PEI | E |
| Initial coloring property | | | | | | | | | |
| Yellow | 1.53 | 1.51 | 1.49 | 1.50 | 1.52 | 1.53 | 1.46 | 1.52 | 1.53 |
| Magenta | 1.62 | 1.62 | 1.61 | 1.61 | 1.62 | 1.61 | 1.55 | 1.60 | 1.59 |
| Cyanic blue | 1.48 | 1.47 | 1.49 | 1.42 | 1.48 | 1.46 | 1.40 | 1.48 | 1.45 |
| Water resistance | | | | | | | | | |
| Yellow | 1.53 | 1.52 | 1.48 | 1.49 | 1.53 | 1.53 | 0.54 | 1.49 | 1.48 |
| Magenta | 1.61 | 1.61 | 1.60 | 1.60 | 1.62 | 1.62 | 0.31 | 1.59 | 1.60 |
| Cyanic blue | 1.48 | 1.47 | 1.47 | 1.41 | 1.48 | 1.47 | 0.18 | 1.48 | 1.44 |
| Light resistance | | | | | | | | | |
| Yellow | 1.12 | 1.15 | 1.15 | 1.15 | 1.10 | 1.13 | 1.18 | 0.58 | 0.85 |
| Magenta | 0.56 | 0.58 | 0.59 | 0.60 | 0.55 | 0.59 | 0.60 | 0.23 | 0.45 |

TABLE 1-continued

| Example No. | 1 | 2 | 3 | 4 | 5 | 6 | C.1 | C.2 | C.3 |
|---|---|---|---|---|---|---|---|---|---|
| Cyanic blue | 1.22 | 1.25 | 1.20 | 1.21 | 1.20 | 1.26 | 0.59 | 1.04 | 1.12 |

Note
*1)PEI: Polyethyleneimine

TABLE 2

| Example No. | 7 | 8 | 9 | 10 | 11 | 12 | C.4 | C.5 |
|---|---|---|---|---|---|---|---|---|
| Polymer | A | B | C | D | A | B | PEI | E |
| Initial coloring property | | | | | | | | |
| Yellow | 0.93 | 0.94 | 0.93 | 0.90 | 0.94 | 0.95 | 0.92 | 0.93 |
| Magenta | 0.96 | 0.96 | 0.94 | 0.93 | 0.95 | 0.96 | 0.93 | 0.95 |
| Cyanic blue | 0.89 | 0.88 | 0.90 | 0.88 | 0.89 | 0.90 | 0.89 | 0.88 |
| Water resistance | | | | | | | | |
| Yellow | 0.92 | 0.93 | 0.93 | 0.89 | 0.93 | 0.95 | 0.92 | 0.93 |
| Magenta | 0.96 | 0.96 | 0.92 | 0.92 | 0.95 | 0.95 | 0.92 | 0.94 |
| Cyanic blue | 0.88 | 0.89 | 0.88 | 0.86 | 0.89 | 0.90 | 0.88 | 0.87 |
| Light resistance | | | | | | | | |
| Yellow | 0.60 | 0.62 | 0.61 | 0.63 | 0.60 | 0.61 | 0.28 | 0.48 |
| Magenta | 0.45 | 0.47 | 0.44 | 0.46 | 0.44 | 0.46 | 0.16 | 0.35 |
| Cyanic blue | 0.75 | 0.76 | 0.73 | 0.75 | 0.75 | 0.77 | 0.50 | 0.61 |

What is claimed is:

1. A recording material comprising:

a base material, and a layer containing at least one polymer selected from the group consisting of a homopolymer of diallylamine, copolymers of diallylamine with (meth)acrylamide and optionally at least one vinyl monomer, which copolymers have essentially no carboxyl group, and acid salts thereof, said layer containing at least one polymer being formed in or on said base material by dipping or coating said base material in or with a liquid containing said polymer, wherein said diallylamine is water-soluble and is present in a molar fraction amount of at least 0.1, said (meth)acrylamide is present in a molar fraction amount of up to 0.9, and said vinyl monomer is present in a molar fraction amount of up to 0.3, and wherein the polymer is contained in an amount of 0.05 to 10 g per square meter of said base material.

2. The recording material according to claim 1, wherein the polymer is the homopolymer of diallylamine.

3. The recording material according to claim 2, wherein the polymer is present in a molar fraction amount of from 0.15 to 0.95.

4. The recording material according to claim 1, wherein the polymer is the copolymer of diallyamine and (meth)acrylamide.

5. The recording material according to claim 4, wherein the diallylamine is present in a molar fraction amount of from 0.15 to 0.95, and the (meth)acrylamide is present in a molar fraction amount of from 0.05 to 0.85.

6. The recording material according to claim 5, wherein the polymer is contained in an amount of 0.1 to 5 g per square meter of the base material.

7. The recording material according to claim 1, wherein the polymer is the copolymer of diallyamine, (meth)-acrylamide and at least one vinyl monomer having essentially no carboxyl group.

8. The recording material according to claim 7, wherein the diallylamine is present in a molar fraction amount of from 0.15 to 0.95, and the (meth)acrylamide is present in a molar fraction amount of from 0.05 to 0.85.

9. The recording material according to claim 8, wherein the polymer is contained in an amount of 0.1 to 5 g per square meter of the base material.

10. The recording material according to claim 7, wherein the vinyl monomer is at least one selected from the group consisting of (meth)acrylonitrile, vinyl acetate, lower alkyl (meth)acrylate, hydroxyalkyl (meth)acrylate and styrenes.

11. The recording material according to claim 10, wherein the diallylamine is present in a molar fraction amount of from 0.15 to 0.95, and the (meth)acrylamide is present in a molar fraction amount of from 0.05 to 0.85.

12. The recording material according to claim 1, wherein the polymer is contained in an amount of 0.1 to 5 g per square meter of the base material and the recording material is suitable for ink jet printing.

13. The recording material according to claim 1, wherein said base material is a member selected from the group consisting of paper, fabric, resin film, and synthetic paper.

14. The recording material according to claim 13, wherein the polymer is contained in an amount of 0.1 to 5 g per square meter of the base material.

15. The recording material according to claim 1, wherein the polymer is contained in said base material by dipping said base material in an impregnation liquid containing the polymer.

16. The recording material according to claim 1, wherein the polymer is contained in a coating layer formed on said base material with a coating liquid containing the polymer.

17. The recording material according to claim 16, wherein said coating layer is coated on said base material in an amount of from 1 to 40 g per square meter.

18. The recording material according to claim 16, wherein said coating layer is coated on said base material in an amount of from 2 to 30 g per square meter.

19. The recording material according to claim 1, wherein the polymer is in the form of an acid salt.

* * * * *